United States Patent [19]

Matsumoto et al.

[11] 3,985,108

[45] Oct. 12, 1976

[54] FUEL SEPARATING SYSTEM FOR STARTING AN INTERNAL COMBUSTION ENGINE

[76] Inventors: Ryohei Matsumoto, 1618, Wakabayashi, Kamimura, Hamana, Shizuoka; Kazuhide Suganuma, 88, Nakayama-cho, Hamamatsu, Shizuoka; Satoru Takahashi, 600-258, Ubumi, Yuto-cho, Hamana, Shizuoka, all of Japan

[22] Filed: July 25, 1974

[21] Appl. No.: 491,926

[30] Foreign Application Priority Data

July 28, 1973 Japan ..... 48-85132
Jan. 31, 1974 Japan ..... 49-13526

[52] U.S. Cl. ..... 123/3; 123/127; 123/179 G

[51] Int. Cl.[2] ..... F02B 43/08

[58] Field of Search ..... 123/179 G, 3, 127, 180 A, 123/119 E, 187.5 R, 122 E, 122 F; 202/269, 185 C

[56] References Cited

UNITED STATES PATENTS

| | | | |
|---|---|---|---|
| 1,382,995 | 6/1921 | Lucke | 123/3 |
| 1,559,214 | 10/1925 | Woolson | 123/3 |
| 2,744,387 | 5/1956 | Reed et al. | 123/122 E |
| 3,683,597 | 8/1972 | Beveridge | 123/136 |
| 3,688,755 | 9/1972 | Grayson et al. | 123/127 |
| 3,783,841 | 1/1974 | Hirschler, Jr. et al. | 123/127 |
| 3,783,849 | 1/1974 | Bramfitt | 123/127 |
| 3,788,283 | 1/1974 | Perry | 123/3 |
| 3,794,000 | 2/1974 | Hodgkinson | 123/127 |
| 3,799,125 | 3/1974 | Hutchinson | 123/127 |
| 3,851,633 | 12/1974 | Shih | 123/127 |
| 3,888,223 | 6/1975 | Mondt | 123/127 |

*Primary Examiner*—Charles J. Myhre
*Assistant Examiner*—James D. Liles
*Attorney, Agent, or Firm*—James C. Wray

[57] ABSTRACT

In an internal combustion engine in which fuel in a fuel tank is sent to the carburetor to be sucked into the engine, a fuel separating system for starting an internal combustion engine comprising means for heating the fuel fed out of the fuel tank and means for cooling a vaporized low-boiling point fuel to condense so that a low-boiling fuel is fractionated out of the fuel in the fuel tank and the engine is started by the thus extracted low-boiling point fuel.

14 Claims, 3 Drawing Figures

FUEL SEPARATING SYSTEM FOR STARTING AN INTERNAL COMBUSTION ENGINE

BACKGROUND OF THE INVENTION

Field of the Invention

The present invention relates to a fuel separating system for starting an internal combustion engine in which a low-boiling point fuel is supplied to the engine when it is started; more particularly it relates to a fuel separating system for starting an internal combustion engine in which at the start of the engine a fractionated gasoline which excels in starting characteristic and in vaporizing characteristic is fed when the engine is cold, with the contribution to the purification of the exhaust gas.

Brief Description of the Prior Art

Generally speaking, an internal combustion engine is hard to start in a cold winter, even when it burns a highly volatile fuel, and it takes time for starting. In that case, starting becomes still more difficult if it is not done swiftly, because trouble occurs in the spark plug.

SUMMARY OF THE INVENTION

An object of the present invention is to provide a fuel separating system for starting an internal combustion engine, in which a highly volatile low-boiling point fuel is extracted out of the fuel and fed to the engine to facilitate the start thereof.

Another object of the present invention is to provide a fuel separating system in which fuel in a fuel tank is sent to a heater, where the fuel is heated and fractionated to a low-boiling point fuel, which is collected through a cooler into a starter tank and therefrom supplied to the engine to facilitate the start of the engine.

Still another object of the present invention is to provide a fractional distillation apparatus which is provided with a cooling chamber and a gasoline-fractionating chamber located adjacent to the cooling chamber, the fractionating chamber being provided with a collecting surface adjacent to the cooling chamber for collecting a low-boiling point fuel.

A fourth object of the present invention is to provide the above-mentioned fractionating chamber with a spherical collecting surface upon which a low-boiling point fuel is condensed and collected.

The other objects, features and advantages of the present invention will become apparent by the following description referring to the attached drawings.

DETAILED DESCRIPTION OF THE INVENTION

Figure 1:
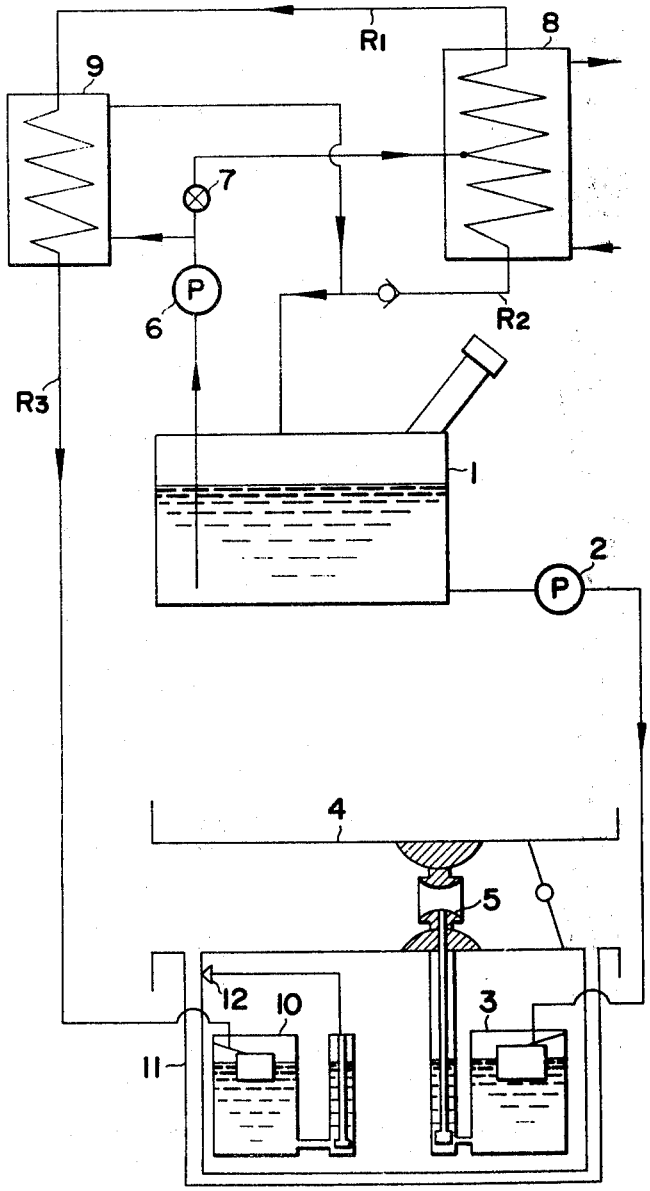
FIG. 1 is a schematic diagram illustrating generally an embodiment of the present invention.

FIG. 1 shows an embodiment of the invention, in which fuel in a fuel tank 1 is sent to a main float tank 3 by a fuel pump 2. In a carburetor 4 opens a main nozzle 5 through which the fuel in the main float tank 3 is flowed to the carburetor 4 to be sucked into the engine for its operation. A heater 8 is connected to the fuel tank 1 through another pump 6 and a flow control nozzle 7. Cooling water by which the engine has been cooled is circulated in the heater 8. The fuel pumped up by the pump 6 is fed into the heater 8. Within the heater 8 there are branched-off upper and lower fuel flow paths $R_1$ and $R_2$. Vaporized fuel is sent through the upper path $R_1$ into a cooler 9 connected to the path $R_1$. Nonvaporized fuel, on the other hand, is returned through the lower path $R_2$ to the fuel tank 1. A part of the fuel pumped up by the pump 6 is circulated within the cooler 9. Being cooled by the fuel circulating within the cooler 9, the evaporized fuel fed into the cooler 9 is condensed. This condensed low-boiling point fuel is collected through a fuel path $R_3$ into a starter tank 10 which is connected thereto. The starter tank 10 opens through a starter passage 11 of the carburetor 4.

In the conventional manner fuel is flowed into the engine intake by the action of suction. The suction is increased in the starter passage 11 drawing fuel from nozzle 12, when the choke closes the main carburetor passage, as shown in the drawing.

The operation of the system will now be described.

While the engine is running, the pump 6 serves to such up the fuel out of the fuel tank 1 to send it to the heater 8. The cooling water which has cooled the engine and has become hot circulates in the heater 8 to heat the fuel to vaporize it. Thus vaporized fuel flows into the cooler 9, while the nonvaporized fuel returns to the fuel tank 1.

A part of the fuel pumped up out of the tank 1 by the pump 6 is diverted to circulate in the cooler 9 to condense the vaporized fuel circulating within the cooler 9 to become a low-boiling point fuel which is collected through the path $R_3$ in the starter tank 10. The starter tank 10 is provided with a float valve which prevents the fuel to be collected from exceeding a predetermined amount. In this manner, a specified amount of the low-boiling point fuel is collected in the starter tank while the engine is running.

When the engine is started, the main path of the carburetor 4 is closed, and the starter path 11 is opened. Thus, the low-boiling point fuel in the starter tank 10 is permitted to flow into the starter nozzle 12 communicating with the starter path 11. Accordingly, the low-boiling point fuel which is highly volatile can be supplied to the engine only when it is started.

As mentioned above, the heater 8 is in this case designed to be heated by the water out of the engine, but of course it may be heated by, for example, the exhaust gas from the engine.

Figure 2:
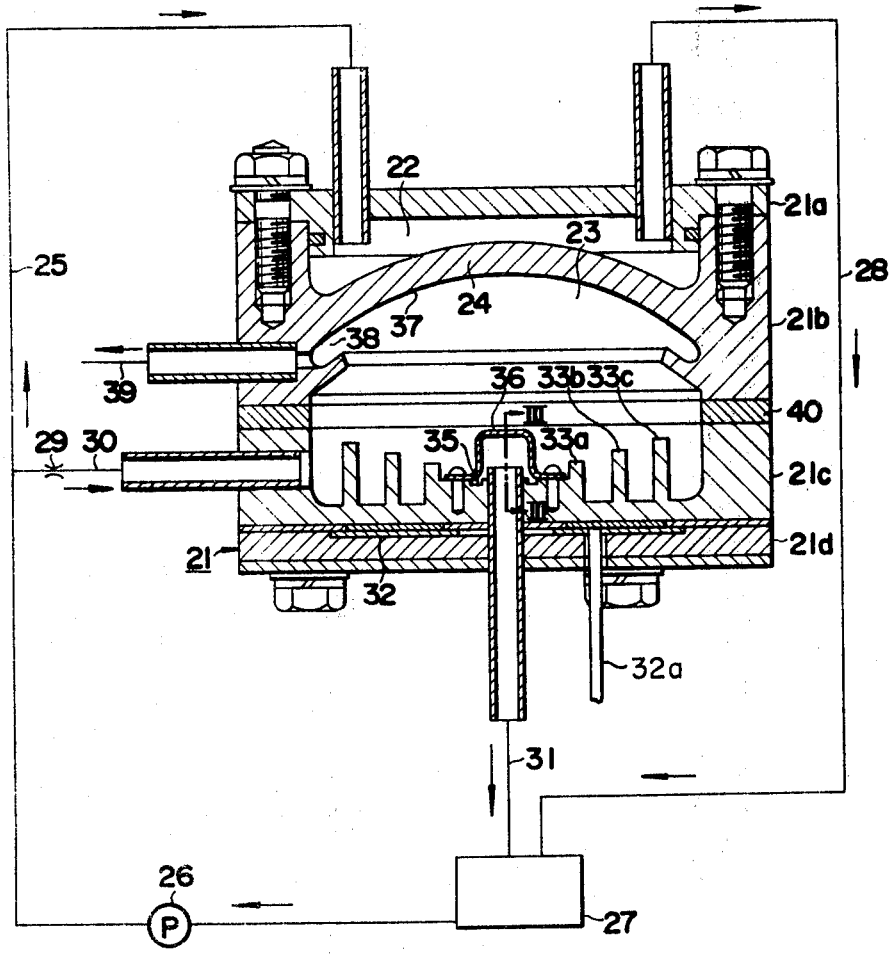
FIG. 2 is a longitudinal section view of a fractional distillation apparatus in another embodiment of the present invention.
Figure 3:
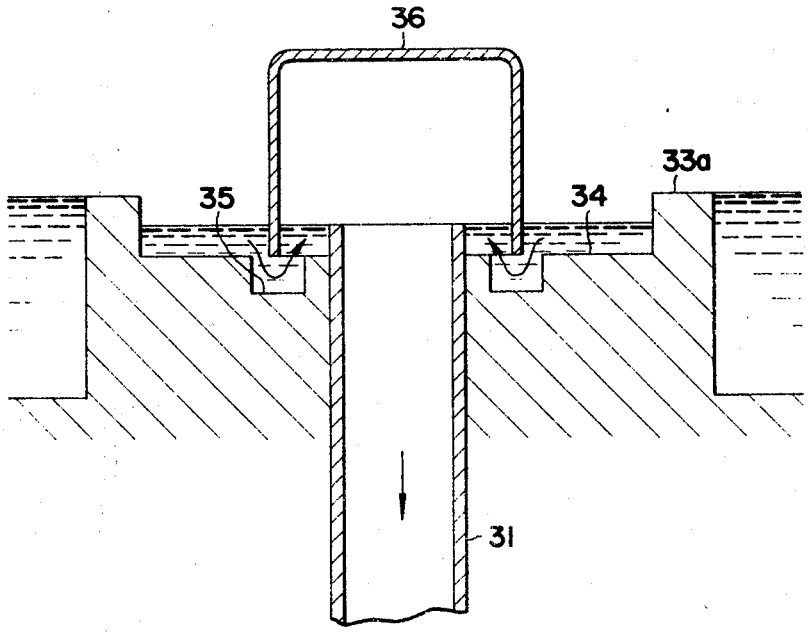
FIG. 3 is an enlarged longitudinal section view of the apparatus along the line III—III of FIG. 2.

FIGS. 2 and 3 illustrate another embodiment of the present invention, in which a main assembly of gasoline fractional distillation apparatus 21 is composed of four members 21*a*, 21*b*, 21*c* and 21*d* for manufacturing purposes. The inner side of the fractional distillation apparatus 21 is separated into an upper cooling chamber 22 and a lower fractionating chamber 23 by a partition wall 24. The cooling chamber 22 communicates with a fuel tank 27 via a conduit 25 and a pump 26 which is interlocked with the engine and also via a conduit 28. Thus the gasoline sucked out of the fuel tank 27 by the pump 26 is introduced via the conduit 25 into the cooling chamber 22 and further circulated via the conduit 28 into the fuel tank 27 so as to cool the partition wall 24.

At the lower part of the side wall of the fractionating chamber 23 opens a conduit 30 which communicates with the conduit 25 downstream of the pump 26 and is provided with a flow control nozzle 29. Meanwhile a conduit 31 opening at the center of the bottom wall of the fractionating chamber 23 communicates with the fuel tank 27, so that a part of gasoline ejected by the pump 26 to flow through the conduit 25 can be introduced into the fractionating chamber 23 via the conduit 30 and further returned to the fuel tank 27 via the conduit 31.

On the bottom wall of the fractionating chamber 23 are formed concentrically annular projecting fins 33a, 33b and 33c which respectively increase in height from the innermost to the outermost thereof so as to increase the gasoline-heating area by a heater 32 held between the lower members 21c and 21d of the fractionating chamber 23 and fed by engine coolant flowing through tubes 32*a*, thereby more effective heating of the gasoline and, at the same time, preventing agitation flow of the gasoline in the fractionating chamber 23 when the vehicle is tilted, or it is started or braked with acceleration or deceleration respectively.

The opening of the conduit 31, as shown in FIG. 3, is located higher than the base 34 of the fin 33a but lower than the top of the fin 33a and on the base 34 is formed an annular groove 35 around the conduit 31. Further, the opening of the conduit 31 is covered with a cap 36 which is located above the groove 35, with its edge flush with the base 34, so that the low-boiling point gasoline heated and vaporized by the heater 32 is prevented from flowing into the conduit 31 together with a liquid gasoline.

The surface, on the side of the fractionating chamber 23 of the partition wall 24 is formed concave as a collecting surface 37.

Thus, the gasoline flowing through the cooling chamber 22 cools the partition wall 24 and accordingly the collecting surface 37, so that the gasoline vaporized in the fractionating chamber 23 can be condensed and collected by the collecting surface 37. Moreover, around the under portion of the collecting surface 37 is formed an annular groove 38 which captures the condensed gasoline flowing down the collecting surface 37. The fractionated gasoline is then collected in a fractionated gasoline tank (not shown) via the conduit 39 opening at the botton of the groove 38.

Further a heat insulating member 40 is inserted between the member 21*c* heated by the heater 32 and the member 21b provided with the partition wall 24 which is cooled by the gasoline.

According to the present invention, when the engine is started, the pump 26 interlocked with the engine is driven as mentioned above to feed the fuel out of the tank 27 to the cooling chamber 22, and the fractionating chamber 23 and at the same time the heater 32 is connected to a power supply to heat the gasoline flowing in the fractionating chamber 23. A part of the gasoline flowing successively over the fins 33c, 33b and 33a into the conduit 31 with its flow rate controlled by the flow control nozzle 29 is heated and vaporized by the heater 32, and the gasoline vapor fills the fractionating chamber 23.

The gasoline vapor filling the fractionating chamber 23 contacts with the collecting surface 37 of the partition wall 24, cooled by the gasoline flowing through the cooling chamber 22, to be condensed into a liquid fractionated gasoline of low-boiling point which flows down the collecting surface 37 into the groove 38 and further reaches via the conduit 39 a starter tank such as is mentioned with respect to the first embodiment.

For cold starting of the engine, just as in the first embodiment the low-boiling point gasoline collected in the fractionated gasoline tank is supplied to the engine, thereby facilitating the start of the engine and contributing to the reduction of imperfectly combusted ingredients of the exhaust gas just after starting the enginge.

In the above-mentioned embodiment the heater 32 is utilized as a means of heating the gasoline in the fractionating chamber 23, and the gasoline is utilized as a cooling medium for the partition wall 24.

The present invention is not restricted to such a manner as given above. For example, hot water in the engine-cooling system may be utilized as the heating means instead of the heater 32, as well as lubricating oil or exhaust gas or, in an aircooled engine, the engine itself or heated wind.

Further, the annular groove 38 may be omitted, if the collecting surface 37 is formed as a triangular plane which is slanted with respect to a horizontal plane, and the conduit 39 opens at the lowest of the apices of the triangular configuration.

Thus, according to the present invention, a low-boiling point, highly volatile fuel is used at the starting of an engine, resulting in a state which promotes easy ignition and in an improvement in the starting characteristic of the engine. Especially in the second embodiment of the present invention, the main assembly is provided with a cooling chamber and with a fractionating chamber so that the gasoline vaporized in the fractionating chamber is captured on the collecting surface of the partition wall dividing these two chambers. Accordingly, the whole system can be made compact, thereby saving the installation space aboard a vehicle and at the same time facilitating the installation work. Also, the present invention provides the effect of reclaiming the fractionated gasoline with high efficiency.

The fractionating may take place within the gasoline tank or separately from the gasoline tank. Pump means to transfer the gasoline includes any form of transfer means including passive flow inducing means such as gravity feeds or heat flow inducing means. A pump means in itself may increase temperature of gasoline or otherwse fractionate. Any means may be employed to separate lighter fluids or more readily vaporized fluids from heavier or more slowly vaporized fluids.

Recently with the air pollution becoming a serious problem, internal combustion engines have come to be equipped with an exhaust gas-purifying device such as the after burner, but the purification of the exhaust gas just after the start when the engine is still cold is considered difficult. According to the present invention, not only is the starting characterisitc improved but also the harmful components of the gas such as hydrocarbons which are exhausted just after starting can be minimized. Moreover, the low-boiling point fuel, which is self-supplied, needs no replenishment.

What is claimed is:

1. In an internal combustion engine in which fuel in a fuel tank is sucked into a carburetor, a fuel separating system for starting the internal combustion engine comprising:

means for pumping up the fuel out of the fuel tank and heating means for heating the pumped up fuel, wherein a cooling water which has been heated as the result of the cooling of the engine is employed as a heating source of said heating means;

separating means for separating the heated fuel by said heating means into the vaporized portion of a low-boiling point fuel and the nonvaporized portion;

cooling means connected to the pump means for flowing fuel from the pump means to the cooling means and absorbing heat in the fuel for cooling and condensing the vaporized portion of the low-boiling point fuel;

storing means for storing the condensed low-boiling point fuel; and nozzle means for effecting the low-boiling point fuel stored in said storing means into a starter passage of the carburetor out of said storing means.

2. A fuel separating system according to claim 1, wherein said heating means and said cooling means are connected by flow paths with each other so that the fuel pumped out of the fuel tank travels successively through said heating means and said cooling means and the condensed low-boiling point fuel is collected in said storing means.

3. A fuel separating system according to claim 1, wherein said heating means and said cooling means are separated by partition wall, the surface of said partition wall on said heating means side forming a collecting surfacce for collecting the vaporized low-boiling point fuel, said collecting surface being connected to said storing means.

4. A fuel separating system according to claim 3, wherein a fractional distillation apparatus is provided to form said heating means and cooling, the inner side of said fractional distillation apparatus is separated by a partition with a large chamber-communicating opening into an upper chamber and a lower chamber which constitutes said cooling means and said heating means or fractionating chamber respectively, said collecting surface being formed in the form of a top-concave spherical surface, said collecting surface being provided with a small annular groove formed around the lower end portion of said collecting surface, said annular groove being connected to said storing means.

5. A fuel separating system according to claim 3, wherein said collecting surface is formed as a triangular plane which is slanted with respect to a horizontal plane, a conduit of said storing means being opened at the lowest one of the three apexes of the triangular configuration of said collecting surface.

6. A method of providing fuel for starting an engine comprising heating fuel with engine coolant, distilling fuel, collecting more volatile fuel, mounting separate containers in an engine carburetor, holding more volatile fuel and less volatile fuel in separate containers, and flowing only the more volatile fuel to a starter passage means bypassing a venturi in the carburetor, thereby supplying only the more volatile fuel to an engine during starting and warm up.

7. The method of claim 6 wherein the flowing step comprises flowing the more volatile fuel into a starter air passage when a main passage in the carburetor is restricted.

8. The method of claim 6 further comprising the initial steps of separating more volatile fuel from a fuel tank and conducting the more volatile fuel and the less volatile fuel to the containers.

9. Starting apparatus for an engine comprising:

a fuel supply heating means connected to the fuel supply and to an engine coolant supply for heating fuel with the engine coolant, distilling means connected to the heating means and collecting means connected to the distilling means for collecting more volatile fuel, fuel supply carburetor means having a main passage and a starter passage, main and starter containers respectively connected in the carburetor means to the main and starter passages for supplying fuel to the passages, only the starter container being connected to the starter passage and less volatile fuel disposed in the main container and more volatile fuel disposed in the starter container.

10. The starting apparatus of claim 9, further comprising separating means for separating more volatile and less volatile fuels and conduit means connected to the separating means and to the containers for separately conducting fuel to the containers.

11. Starting apparatus comprising a fuel supply, fractionating means connected to the fuel supply for fractionating fuel into more volatile fuel and less volatile fuel, heater means connected to the fractionating means for heating and evaporating fuel, engine coolant means connected to the heating means for heating the fuel, and cooling means connected to the fuel supply and to the fractionating means for cooling evaporated fuel with fuel from the fuel supply, and carburetor storage means for separately storing and providing the more volatile fuel and the less volatile fuel to an engine.

12. A fuel separating system having a fractionating chamber with a heated base and a cooled top, means to flow liquid fuel into the container and means to flow vaporized fuel from the chamber and a conduit connected to the chamber for leading liquid fuel to a gas tank, wherein a plurality of annular fins are concentrically projected on the inside wall of said fractionating chamber which constitutes said heating means for preventing splashing and lateral accelerations of liquid fuel in said fractionating chamber and for extending a fuel-heating area by a heater mounted in said fractionating chamber, and wherein a conduit leading to the fuel tank is communicated with said fractionating chamber in a manner so that said conduit is opened in said fractionating chamber at a level within a range between the top and bottom levels of the innermost one of said concentric projecting fins; an annular groove is formed in a bottom of said fractionating chamber around said conduit; the opening of said conduit is covered with a cap, the lower edge of which is located above said groove and is flush with said bottom of said fractionating chamber, so that the vaporized low-boiling point gasoline heated by said heating means is prevented from flowing into said conduit and only a liquid gasoline is allowed to flow into said conduit.

13. In an internal combustion engine in which fuel in a fuel tank is sucked into a carburetor, a fuel separating system for starting the internal combustion engine comprising:

means for pumping up the fuel out of the fuel tank and heating means for heating the pumped up fuel, wherein the heating means comprises a fractionating chamber, and a plurality of annular fins are concentrically projected on the inside wall of said fractionating chamber for preventing splashing and lateral accelerations of liquid fuel in said fractionating chamber and for extending a fuel heating area by a heater mounted in said fractionating chamber;

separating means for separating the heated fuel by said heating means into the vaporized portion of a low-boiling point fuel and the nonvaporized portion;

cooling means connected to the pump means for flowing fuel from the pump means to the cooling means and absorbing heat in the fuel for cooling and condensing the vaporized portion of the low-boiling point fuel;

storing means for storing the condensed low-boiling point fuel; and nozzle means for effecting the low-boiling point fuel stored in said storing means into a starter passage of the carburetor out of said storing means.

14. A fuel separating system according to claim 13, wherein a conduit leading to the fuel tank is communicated with said fractionating chamber in a manner so that said conduit is opened in said fractionation chamber at a level within a range between the top and bottom levels of the innermost one of said concentric projecting fins; an annular groove is formed in a bottom of said fractionating chamber around said conduit; the opening of said conduit is covered with a cap, the lower edge of which is located above said groove and is flush with said bottom of said fractionating chamber, so that the vaporized low-boiling point gasoline heated by said heating means is prevented from flowing into said conduit and only a liquid gasoline is allowed to flow into said conduit.

* * * * *